US007619582B2

(12) United States Patent
Chung et al.

(10) Patent No.: US 7,619,582 B2
(45) Date of Patent: Nov. 17, 2009

(54) PRINTED MONOPOLE SMART ANTENNA FOR WLAN AP/ROUTER

(75) Inventors: Shyh-Jong Chung, Taoyuan County (TW); Yen-Chih Liu, Taoyuan County (TW)

(73) Assignee: Delta Networks, Inc., Taoyan County (TW)

( * ) Notice: Subject to any disclaimer, the term of this patent is extended or adjusted under 35 U.S.C. 154(b) by 0 days.

(21) Appl. No.: 12/044,453

(22) Filed: Mar. 7, 2008

(65) Prior Publication Data

US 2009/0079657 A1 Mar. 26, 2009

(30) Foreign Application Priority Data

Sep. 20, 2007 (TW) ..... 96135231 A

(51) Int. Cl.
*H01Q 3/24* (2006.01)

(52) U.S. Cl. ..... 343/876; 343/833; 343/834

(58) Field of Classification Search ..... 343/833, 343/834, 876

See application file for complete search history.

(56) References Cited

U.S. PATENT DOCUMENTS

| | | | | |
|---|---|---|---|---|
| 5,926,510 | A | 7/1999 | Suzuki | |
| 6,873,293 | B2 * | 3/2005 | Proctor et al. | 343/702 |
| 7,180,464 | B2 * | 2/2007 | Chiang et al. | 343/833 |
| 7,224,321 | B2 * | 5/2007 | Chiang et al. | 343/833 |
| 7,242,366 | B2 * | 7/2007 | Shibata | 343/893 |
| 2005/0190115 | A1 | 9/2005 | Chiang et al. | |
| 2007/0152892 | A1 | 7/2007 | Chiang et al. | |

FOREIGN PATENT DOCUMENTS

| | | |
|---|---|---|
| EP | 1589610 | 10/2005 |
| EP | 1729367 | 12/2006 |
| EP | 1808931 | 7/2007 |
| EP | 2040331 | 3/2009 |
| JP | 2006005645 | 1/2006 |
| WO | 2006020923 | 2/2006 |

OTHER PUBLICATIONS

European Search Report, dated Jan. 13, 2009, European Appln. No. EP08004619.

* cited by examiner

*Primary Examiner*—Hoang V Nguyen
(74) *Attorney, Agent, or Firm*—Volpe and Koenig, P.C.

(57) ABSTRACT

A printed monopole smart antenna is provided. The smart antenna includes a monopole antenna having a plane for receiving and transmitting a signal, two conductors for directing and/or reflecting the signal to the monopole antenna respectively, and a circuit device electrically connected between the first and second conductors, for selectively switching the first and second conductors to determine an operation mode of the smart antenna. The smart antenna further has at least a groove in the ground for concentrating the current distribution and solving the influence of the antenna gain to the ground size. The sequence of the antenna pattern of the smart antenna is randomly arranged, depending on user's situation. When a plurality of printed monopole smart antennas are disposed on different directions of the WLAN AP/router, the omnidirectional radiation pattern will be obtained and the antenna gain will be increased.

19 Claims, 7 Drawing Sheets

PRINTED MONOPOLE SMART ANTENNA FOR WLAN AP/ROUTER

FIELD OF THE INVENTION

The present invention relates to a monopole smart antenna. In particular, the present invention relates to a printed monopole smart antenna applied in the Wireless Local Area Network (WLAN) access point (AP).

BACKGROUND OF THE INVENTION

Since Internet is popular in recent years, individuals and enterprises have the demand for the network significantly. The substantial lines of the Local Area Network (LAN) are needed not only to construct at a time, but also to increase the construction cost and decrease the efficiency of construction. Moreover, the temporary demand of network cannot be satisfied. The appearance of WLAN can decrease the construction cost, expand the signal range of Intranet and satisfy the demand of connection to the network on the go.

However, the acceptance and transmission of the WLAN signal are processed through the WLAN AP/router or the antenna of the wireless network card of the laptop computer. At present, monopole antennas, dipole antennas, chip antennas, or helical antennas can be utilized in these wireless network products. The covering ranges of these kinds of antenna patterns are about 360 degrees. From the viewpoint of application, the advantage lies in that more users can use Internet through the AP/router or the wireless network card. However, since the antenna gain is not high, the wireless communication distance is limited. In order to increase the antenna gain, directional antennas can be utilized to increase the transmitting distance.

The most current smart antennas select the desired antenna direction to proceed the communicating transmission by several directional antennas through turning on/off the diode switch from the software. The advantages of these directional smart antennas lie in that (1) the antenna pattern is switched automatically according to users' area, (2) high antenna gain is obtained, and (3) the antenna pattern is controlled by the software. However, the utility rate of this antenna pattern is not high, and only one signal direction is switched. One antenna only has one directional pattern.

Another smart antenna utilizes the single pole double throw (SPDT) diode of Yagi antenna to switch a capacitance to the ground or an inductance to the ground, and the conductor plays the role on the director or the reflector so as to change the antenna pattern. The advantages of using the capacitance or the inductance lie in that the operation will be more convenient than using equivalent capacitance or equivalent inductance, and the conductor is easily replaced while in the low frequency. However, the drawback lies in that the selected capacitance or inductance will become too small to be used if the higher frequency is operated. This is because the capacitance value and the inductance value are too small for manufacturing the element, or because the self-resonant frequency is too low to be used. In other words, the method of switching the capacitance or the inductance is limited in the frequency. The SPDT diode needs two kinds of voltages for selection, and has more complicated circuit design and higher cost. In addition, the insertion loss of the SPDT diode is larger than that of the pin diode, and the antenna gain of the SPDT diode becomes smaller.

It is therefore attempted by the applicant to deal with the above situation encountered in the prior art.

SUMMARY OF THE INVENTION

In accordance with one aspect of the present invention, a smart antenna is provided. The smart antenna includes: a monopole antenna having a reverse triangle plane for receiving and transmitting a signal; a first conductor with a first switch diode disposed on a first side of the monopole antenna and electrically connected to a ground, for conducting one of actions of directing the signal and reflecting the signal to the monopole antenna; a second conductor with a second switch diode disposed on a second side of the monopole antenna and electrically connected to the ground, for conducting one of actions of directing the signal and reflecting the signal to the monopole antenna; a circuit device electrically connected between the first conductor and the second conductor, for turning on/off the first switch diode and the second switch diode; and at least one groove disposed in the ground and horizontal with the ground, for concentrating a current of the signal received from/transmitted to the monopole antenna. The smart antenna switches among four patterns formed by selectively turning on/off the first switch diode and the second switch diode.

Preferably, the reverse triangle plane has a first edge and a second edge, where each of the first edge and the second edge has at least one cutout, and a third edge parallel to the ground, and a distance between every two neighboring cutouts is constant.

Preferably, each of the first edge and the second edge has at least two cutouts on the plane, and a distance between every two neighboring cutouts is constant.

Preferably, the cutout has a length increased with a decrease of a length of the third edge.

Preferably, the at least one groove is disposed perpendicular to the monopole antenna, the first conductor and the second conductor.

In accordance with another aspect of the present invention, a smart antenna is provided. The smart antenna includes: a monopole antenna having a plane for receiving and transmitting a signal; a first conductor for conducting one of actions of directing the signal and reflecting the signal to the monopole antenna; a second conductor for conducting one of actions of directing the signal and reflecting the signal to the monopole antenna; and a circuit device electrically connected between the first conductor and the second conductor, for selectively switching the first and second conductors to determine an operation mode of the smart antenna.

Preferably, the first conductor with a first switch diode and the second conductor with a second switch diode respectively are disposed on a first side and a second side along the monopole antenna and electrically connected to a ground, and the smart antenna switches among four patterns formed by turning on/off the first switch diode and the second switch diode.

Preferably, the monopole antenna further includes a feeding point being a signal input port.

Preferably, the plane has at least three edges including a first, a second and a third edges, where each of the first edge and the second edge has at least one cutout on the plane and the third edge is parallel to the ground.

Preferably, each of the first edge and the second edge has at least two cutouts on the plane, and a distance between every adjacent two neighboring cutouts is constant.

Preferably, the monopole antenna has a length equal to a half of a wavelength of the signal.

Preferably, the first conductor and the second conductor have a length equal to 0.1~0.5 times of a wavelength of the signal.

Preferably, the monopole antenna and the first conductor have a first distance therebetween equal to 0.1~0.5 times of a wavelength of the signal, and the monopole antenna and the second conductor have a second distance therebetween equal to 0.1~0.5 times of the wavelength of the signal.

Preferably, the first conductor further includes a first inductance, the second conductor further includes a second inductance, and the first inductance and the second inductance are electrically connected to the circuit device for being blocked at a high frequency.

Preferably, one third part of the first conductor and one third part of the second conductor are overlapped with the ground, and terminals of the first conductor and the second conductor are electrically connected to the ground.

Preferably, each of the first conductor and the second conductor is one of a rectangle shape and a reverse L-shape.

Preferably, the monopole antenna, the first conductor and the second conductor are made of a metal material.

Preferably, the second conductor is opposite to the first conductor.

In accordance with another aspect of the present invention, an operation method for a smart antenna is provided. The smart antenna includes a monopole antenna, a first conductor, a second conductor and a circuit device, the first conductor includes a first switch diode, and the second conductor includes a second switch diode. The operation method includes a step of: controlling the circuit device via turning on/off the first switch diode and turning on/off the second switch diode simultaneously, so as to switch among a plurality of operation modes of the smart antenna.

Preferably, a sequence of a first, a second, a third, and a fourth antenna patterns is randomly arranged.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The smart antenna of the present invention is designed by applying the concept of director and reflector in the theory of Yagi antenna. The antenna pattern of the smart antenna can be switched automatically according to the users' area. The antenna gain of the smart antenna can be increased, the antenna pattern can be switched automatically by controlling the software, and the covering range of the antenna pattern can be expanded so as to widely applied in the wireless communication.

Figure 1:
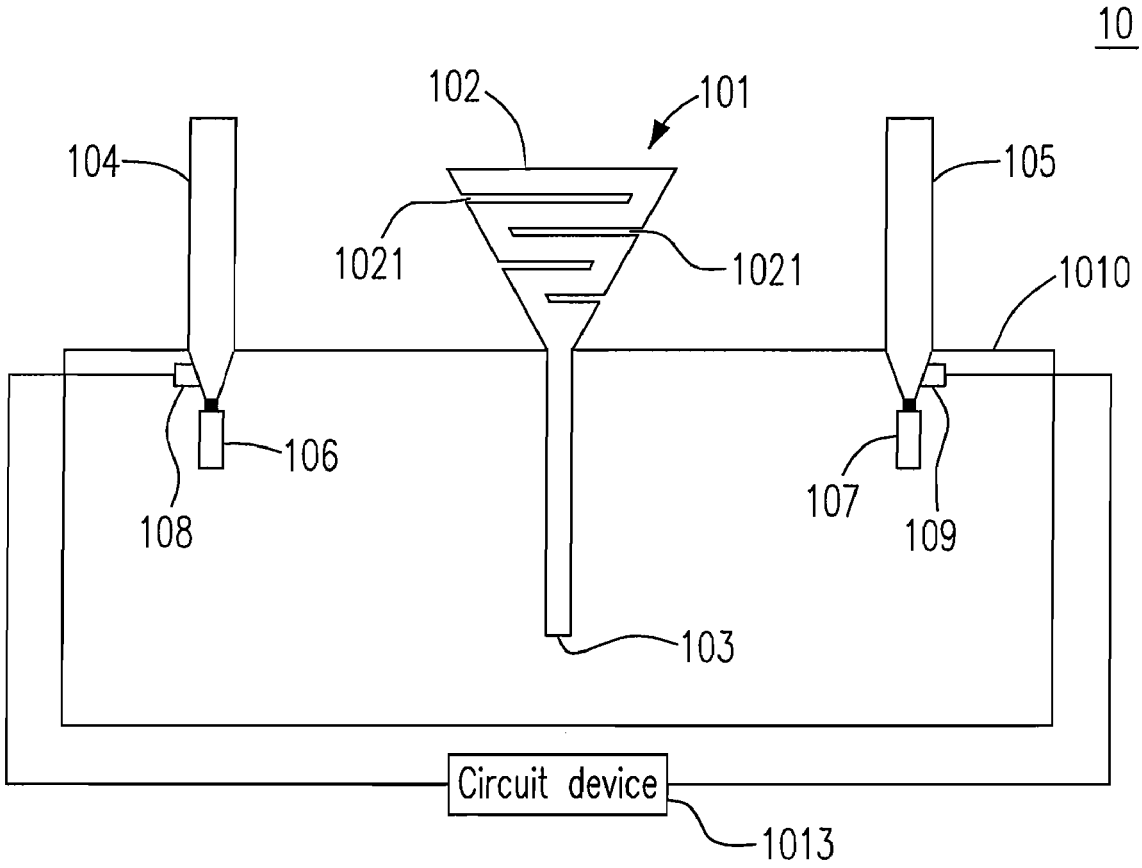
FIG. 1 is a structural diagram showing a smart antenna in accordance with the first preferred embodiment of the present invention.

Please refer to FIG. 1, which is a structural diagram showing a smart antenna in accordance with the first preferred embodiment of the present invention. In FIG. 1, the smart antenna 10 includes a monopole antenna 101, a first conductor 104, a second conductor 105 and a circuit device 1013. The smart antenna 10 is printed on a printed circuit board, and the monopole antenna 101, the first conductor 104 and the second conductor 105 are made of metal. The monopole antenna 101 includes a main antenna 102 and a feeding point 103. The main antenna 102 is disposed on the upper layer of the printed circuit board. The monopole antenna 101 is utilized for receiving and transmitting a signal. The first conductor 104 includes a first switch diode 106. The first conductor 104 is disposed in the first side of the monopole antenna 101, and the end point of the first conductor 104 is electrically connected to the ground 1010. The second conductor 105 includes a second switch diode 107. The second conductor 105 is disposed in the second side of the monopole antenna 101, and the end point of the second conductor 105 is electrically connected to the ground 1010. The second side and the first side are the opposite sides. The function of the first and second conductors (104, 105) is similar to that of the director or reflector of Yagi antenna. It means that the first conductor 104 plays the role of the director or reflector on directing or reflecting the signal. The second conductor 105 has the same function and depends on the control of the circuit device 1011. The circuit device 1011 is electrically connected to the first conductor 104 and the second conductor 105 respectively, for generating an instruction to switch turning-on/off of the first switch diode 106, and generating another instruction to switch turning-on/off of the second switch diodes 107, so as to change the director/reflector function of the first conductor 104 and the direction/reflector function of the second conductor 105. Then the antenna pattern of the smart antenna is changed. When the first or second switch diode (106, 107) is turned on, the first or second conductor (104, 105) has the function of reflector. On the contrary, when the first or second switch diode (106, 107) is turned off, the first or second conductor (104, 105) has the function of director.

Please refer to FIG. 1. The main antenna 102 of the monopole antenna 101 is disposed on the upper layer of the printed circuit board. The plane has at least three edges, at least a cutout 1021 is connected to the first edge and the second edge on the plane respectively, and the third edge is parallel to a horizontal line of the ground 1010. The lengths of the cutouts 1021 are shortened with the distance of the third edge lengthened, and the distance between every adjacent two neighboring cutouts 1021 is identical. Although the main antenna 102 is a plane, the shape of the main antenna 102 having a plurality of cutouts 1021 is S-shape, which can increase the equivalent length of the monopole antenna 101 and increase the effect of the director. When the resonance frequency of the main antenna 102 of the first preferred embodiment of the present invention is 2.45 GHz, the path length of the main antenna 102 is designed as half of the wavelength of the signal, and the lengths of the first and second conductors (104, 105) are 0.2 times of the wavelength thereof. The distances from the monopole antenna 101 to the first conductor 104 and to the second conductor 105 respectively are identical, and the distances are 0.2 times of the wavelength of the signal. In addition, one third part of the first and second conductors (104, 105) are overlapped by the ground 1010, and the end points of the first and second conductors (104, 105) respectively are electrically connected to the ground 1010. The first and second conductors (104, 105) include but not limit in a rectangle and a reverse L-shape, only if the equivalent length of the smart antenna is the resonance length.

In FIG. 1, the first conductor 104 further includes a first inductance 108, and the second conductor 105 further includes a second inductance 109. The first and second inductances (108, 109) respectively are electrically connected to the circuit device 1011 for being blocked at a high frequency.

Figure 2:
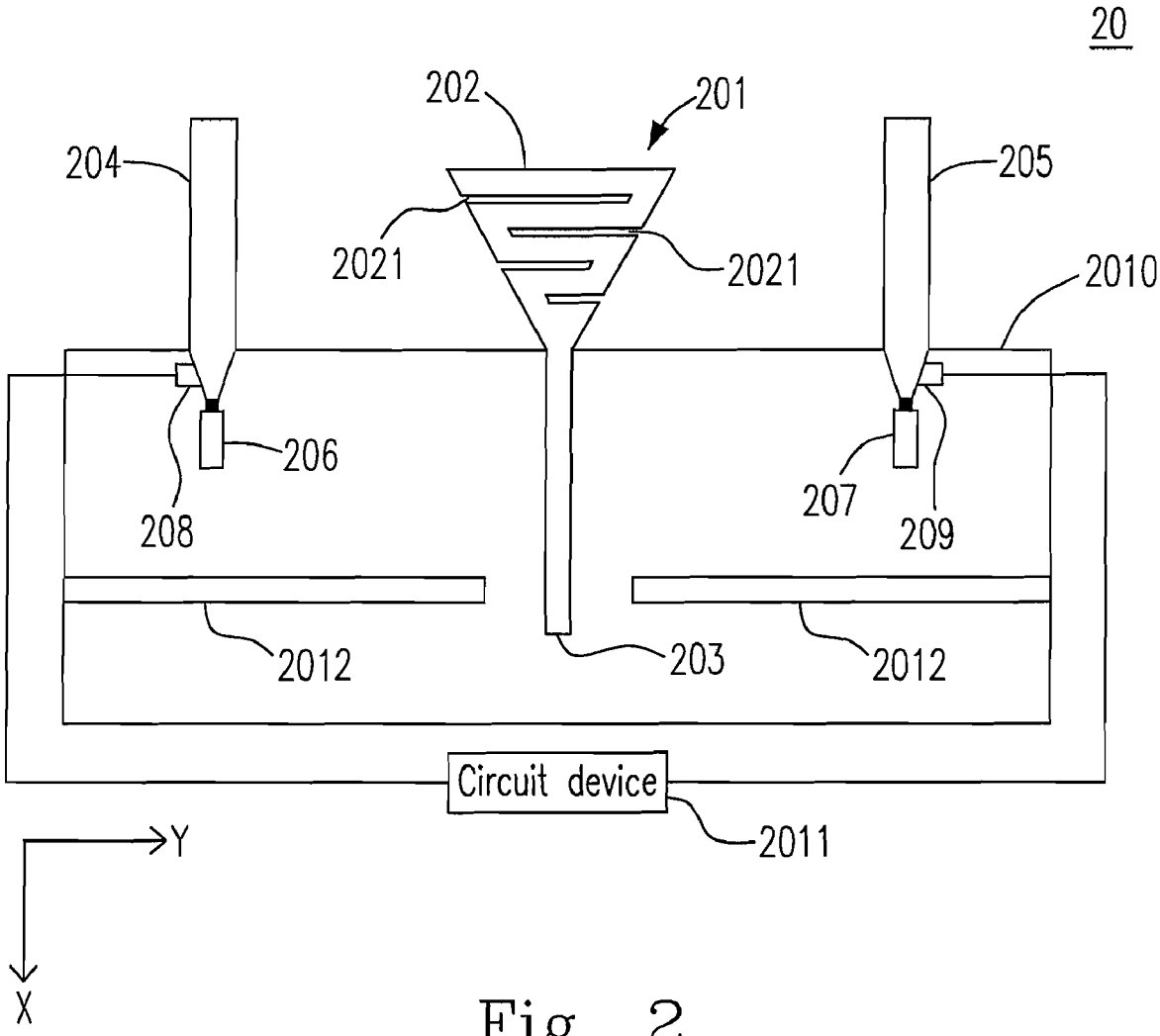
FIG. 2 is a structural diagram showing a smart antenna in accordance with the second preferred embodiment of the present invention.

Please refer to FIG. 2, which is a structural diagram showing a smart antenna in accordance with the second preferred embodiment of the present invention. In FIG. 2, the smart antenna 20 includes a monopole antenna 201, a first conductor 204, a second conductor 205 and a circuit device 2011. The smart antenna 20 is printed on a printed circuit board, and the monopole antenna 201, the first conductor 204 and the second conductor 205 are made of metal in general. The monopole antenna 201 includes a main antenna 202 and a feeding point 203. The main antenna 202 is a reverse triangle plane, and the feeding point 203 is electrically connected to a ground 2010. The monopole antenna 201 is utilized for receiving and transmitting a signal. The first conductor 204, which is disposed in the first side of the monopole antenna, includes a first switch diode 206 and is electrically connected to the ground 2010. The second conductor 205, which is disposed in the second side of the monopole antenna 201, includes a second switch diode 207 and is also electrically connected to the ground 2010. The second side and the first side are the opposite sides. As described in the smart antenna 10 of the first preferred embodiment, the functions of the first and second conductors (204, 205) of the smart antenna 20 of the second preferred embodiment is like the director or the reflector of Yagi antenna. It means that the first conductor 204 plays the role of the director or reflector on directing or reflecting the signal, and so as the second conductor 205. The role of the second conductor 205 depends on the control of the circuit 2011.

The circuit device 2011 is electrically connected to the first and second conductor (204, 205) respectively, for generating an instruction to turn on or turn off the first switch diode 206, and for generating another instruction to turn on or turn off the second switch diodes 207, so as to change the director/reflector function of the first conductor 204 and the direction/reflector function of the second conductor 205 respectively. Then the antenna pattern of the smart antenna is changed.

Please refer to FIG. 2, the main antenna 202 of the monopole antenna 201 is a reverse triangle plane, wherein the first edge and the second edge respectively are connected to at least a cutout 2021 on the reverse triangle plane, and the third edge is parallel to a horizontal line of the ground 2010. The lengths of the cutouts 2021 are shortened with the distance of the third edge lengthened, and the distance between the every adjacent two neighboring cutouts 2021 is identical. Although the main antenna 202 is a reverse triangle plane, the shape of the main antenna 202 having a plurality of cutouts 2021 is S-shape, which can increase the equivalent length of the monopole antenna 201 and increase the effect of the director. When the resonance frequency of the main antenna 202 of the second preferred embodiment of the present invention is 2.45 GHz, the path length of the main antenna 202 is designed as half of the wavelength of the signal, and the lengths of the first and second conductors (204, 205) are 0.2 times of the wavelength thereof. The distances from the monopole antenna 201 to the first conductor 204 and to the second conductor 205 respectively are identical, and the distances are 0.2 times of the wavelength of the signal. In addition, one third of the first and second conductors (204, 205) are electrically connected to the ground 2010. The first and second conductors (204, 205) include but not limit in a rectangle and a reverse L-shape, only if the equivalent length of the monopole antenna 20 is the resonance length.

In FIG. 2, the first conductor 204 further includes a first inductance 208, and the second conductor 205 further includes a second inductance 209. The first and second inductances (208, 209) respectively are electrically connected to the circuit device 2011, for being blocked at a high frequency.

The largest difference between the smart antenna 20 and the smart antenna 10 of the first preferred embodiment lies in that at least an groove 2012 is disposed in the ground 2010. This is because the area size of the ground 2010 will be effected the antenna gain of the smart antenna 20. When the signal is fed into the main antenna 202, the current will be generated in the ground 2010. The current is inducted to the first and second conductors (204, 205) by grounding or passing through an equivalent capacitance. For the purpose of that the antenna pattern and the current distribution are not affected by the width of ground 2010, and the current distribution is concentrated and the current flows to the first and second conductors (204, 205), at least an groove 2012 is disposed in the ground 2010. The groove 2012 is horizontal to the ground 2010, and is perpendicular to the monopole antenna 201, the first conductor 204 and the second conductor 205 respectively, for concentrating the current received and transmitted from the monopole antenna 201. Therefore, the influence of the area size of ground 2010 by the antenna gain is effectively solved by disposing the groove 2012 in the ground 2010.

From the smart antenna 20 of the second preferred embodiment in FIG. 2, an operation method of the smart antenna 20 of the present invention is provided. The smart antenna 20 includes a monopole antenna 201, a first conductor 204, a second conductor 205 and a circuit device 2011, wherein the first conductor 204 includes a first switch diode 206, and the second conductor 205 includes a second switch diode 207. The operation method of the smart antenna includes the step of: controlling the circuit device 2011 via turning on/off the first switch diode 206 and turning on/off the second switch diode 207 simultaneously. Four antenna gains are generated by turning on and turning off the first switch diode 206 and the second switch diode 207. These four antenna gains are described as follows.

In order to obtain the first antenna pattern (referring to FIG. 3), the circuit device 2011 is controlled for turning off the first switch diode 206, and the first conductor 204 is being the conductor. When the circuit device 2011 is controlled, the second switch diode 207 is turned on simultaneously, and the second conductor 205 is being the reflector. Then the first antenna pattern is generated. Turning on the second switch diode 207 make the second conductor 205 grounded. Because of the refection principle, the equivalent length of the second conductor 205 is longer than that of the monopole antenna 201. The second conductor 205 is being the reflector, and the antenna pattern is extruded to the monopole antenna 201. However, the first switch diode 206 is turned off. Equivalently, the first conductor 204 is a equivalent length and is grounded to a capacitance value. Since the equivalent length of the first conductor 204 is shorter than that of the monopole antenna 201, the first conductor 204 is being the director. The extruded pattern by the second conductor 205 is directed to the monopole antenna 201 for increasing the antenna gain.

It is to be noticed that the part which connects the first and second conductor (204, 205) to the ground 2010 forms the characteristic of the grounded capacitance on the director (first conductor 204) and of the competent to be coupled to the grounded current. While the main antenna 202 of the monopole antenna 201 is radiated, in addition to the antenna gain generated from the director resonated, the current on the ground 2011 is coupled to the director so as to increase the antenna gain.

Figure 3:
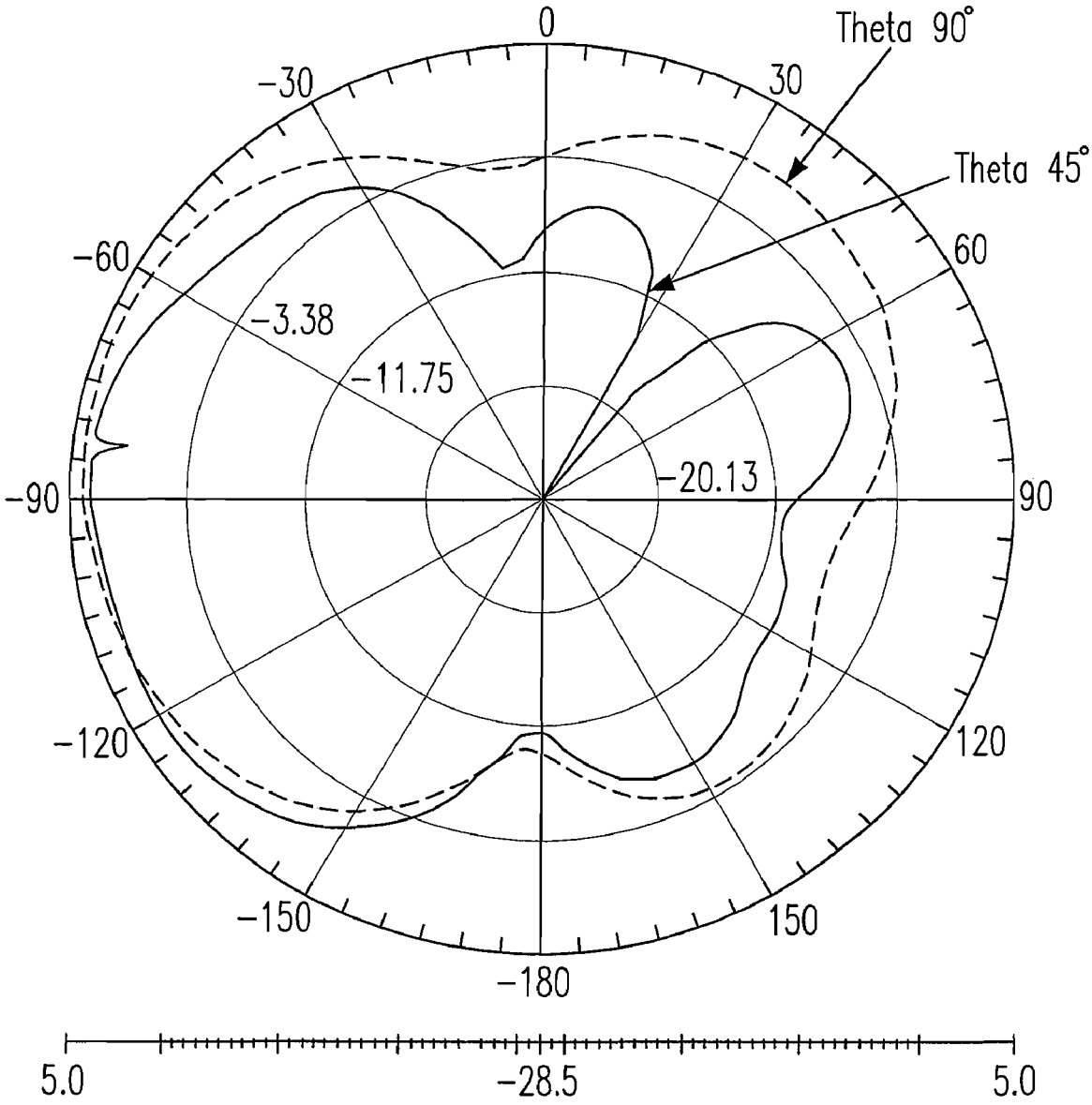
FIG. 3 is a data simulating diagram showing a first antenna pattern of the smart antenna in accordance with the second preferred embodiment of the present invention.

Please refer to FIG. 3, which is a data simulating diagram showing a first antenna pattern of the smart antenna in accordance with the second preferred embodiment of the present invention. In FIG. 3, the larger antenna pattern is formed between the first director 204 and the monopole antenna 201 on the horizontal plane (X-Y plane), and the antenna gain is increased to 5 dBi.

In order to obtain the second antenna pattern (referring to FIG. 4), the circuit device 2011 is controlled for turning on the first switch diode 206, and the first conductor 204 is being the reflector. When the circuit device 2011 is controlled, the second switch diode 207 is turned off simultaneously, and the second conductor 205 is being the director. Then the second antenna pattern is generated. Similarly, the first conductor 204 is being the reflector, and the antenna pattern is extruded to the monopole antenna 201. However, the second conductor 205 is being the director, and the pattern extruded by the first conductor 204 is directed to the monopole antenna 201 for increasing the antenna gain.

Figure 4:
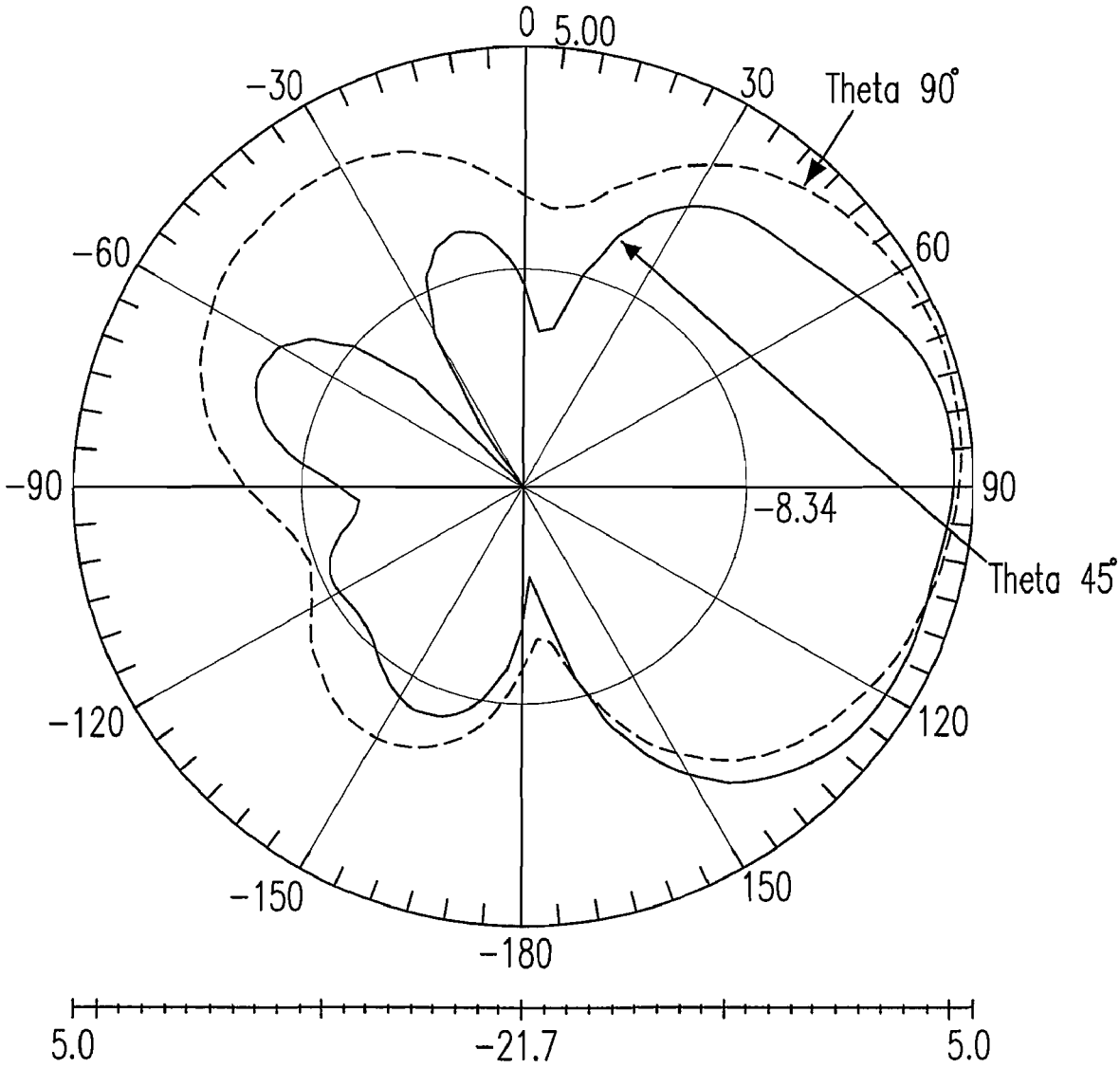
FIG. 4 is a data simulating diagram showing a second antenna pattern of the smart antenna in accordance with the second preferred embodiment of the present invention.

Please refer to FIG. 4, which is a data simulating diagram showing a second antenna pattern of the smart antenna in accordance with the second preferred embodiment of the present invention. In FIG. 4, the larger antenna pattern is formed between the second conductor 205 and the monopole antenna 201 on the horizontal plane (X-Y plane), and the antenna gain is increased to 5 dBi.

In order to obtain the third antenna pattern (referring to FIG. 5), the circuit device 2011 is controlled for turning off the first switch diode 206, and the first conductor 204 is being the director. When the circuit device 2011 is controlled, the second switch diode 207 is turned off simultaneously. Then the second conductor 205 is being the director, and the third antenna pattern is generated. Now, the antenna pattern is directed to the first and second conductors (204, 205) for increasing the antenna gain.

Figure 5:
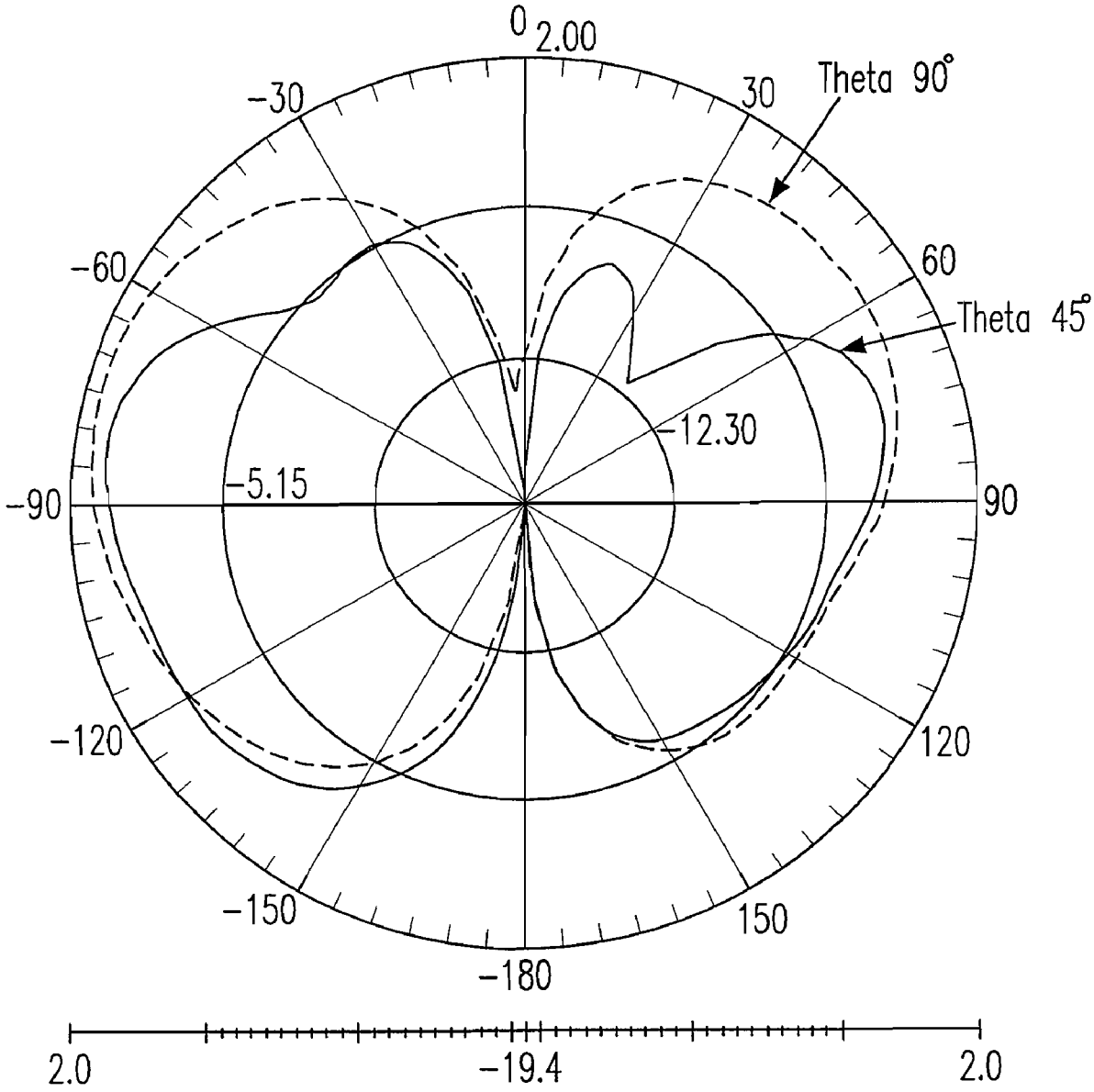
FIG. 5 is a data simulating diagram showing a third antenna pattern of the smart antenna in accordance with the second preferred embodiment of the present invention.

Please refer to FIG. 5, which is a data simulating diagram showing a third antenna pattern of the smart antenna in accordance with the second preferred embodiment of the present invention. In FIG. 5, on the horizontal plane (X-Y plane), the antenna pattern between the first conductor 204 and the monopole antenna 201 and another antenna pattern between the second conductor 205 and the monopole antenna 201 are larger than those in FIG. 3 and in FIG. 4. The antenna gain is increased to 1~2.5 dBi.

In order to obtain the fourth antenna gain (referring to FIG. 6), the circuit device 2011 is controlled for turning on the first switch diode 206, and the first conductor is being the reflector. When the circuit device 2011 is controlled, the second switch diode 207 is turned on simultaneously, and the second conductor 205 is being the reflector. The fourth antenna pattern is generated. Now, the first and second conductor (204, 205) are all extruded the antenna pattern to the monopole antenna 201 for increasing the antenna gain.

Figure 6:
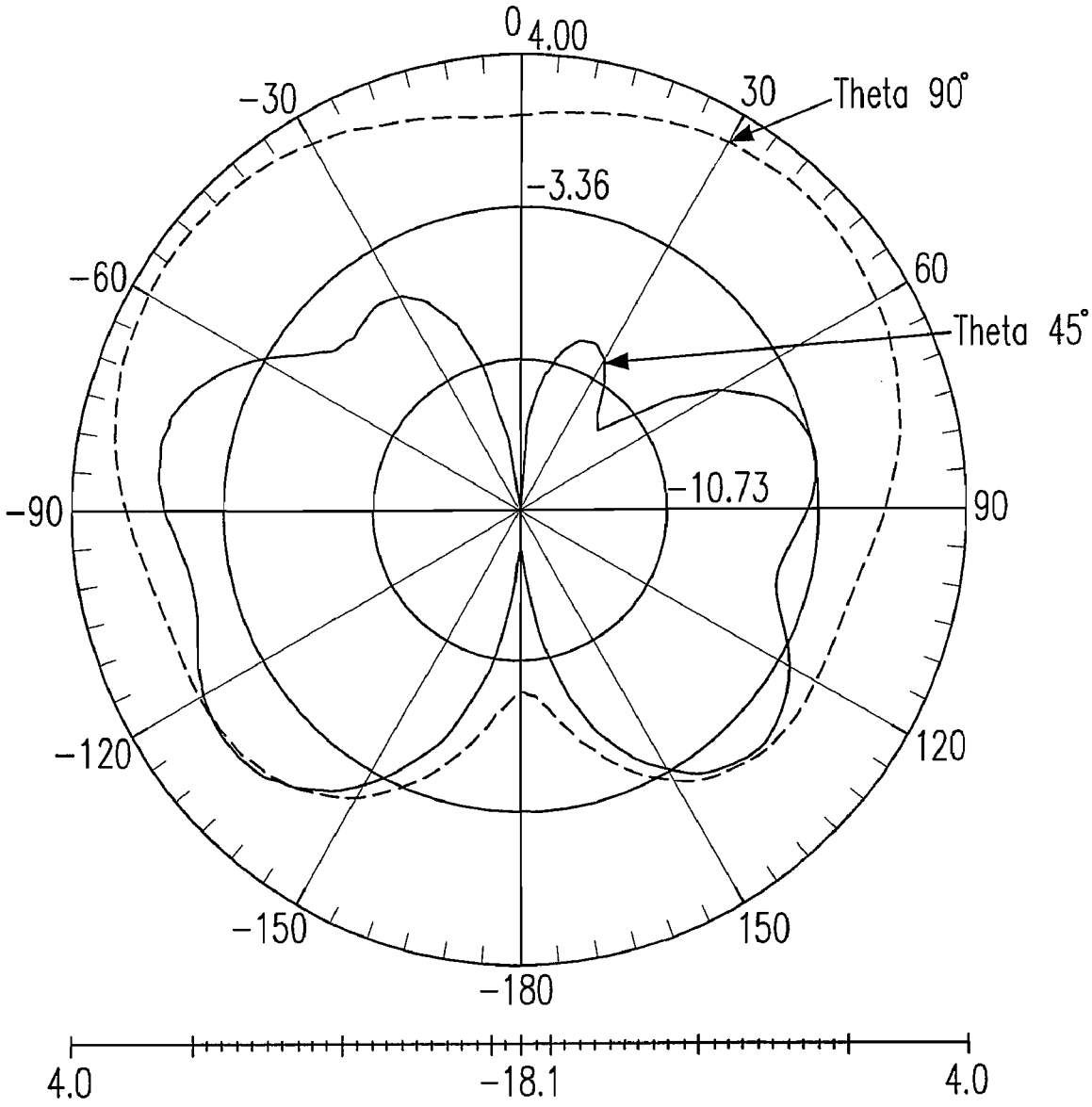
FIG. 6 is a data simulating diagram showing a fourth antenna pattern of the smart antenna in accordance with the second preferred embodiment of the present invention.

Please refer to FIG. 6, which is a data simulating diagram showing a fourth antenna pattern of the smart antenna in accordance with the second preferred embodiment of the present invention. In FIG. 6, the antenna pattern on the horizontal plane (X-Y plane) is smaller than those of the first, second and third antenna patterns (referring to FIGS. 3 to 5), and the antenna gain is increased to 3~3.5 dBi.

Figure 7:
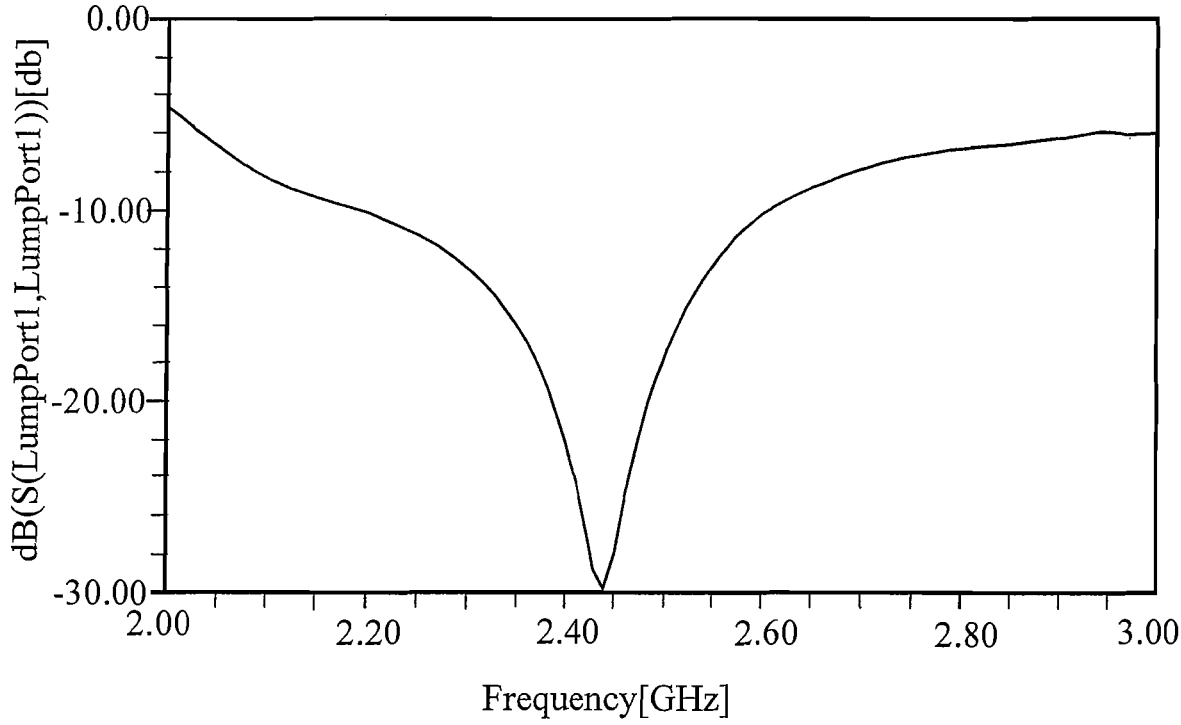
FIG. 7 is a diagram showing a frequency and a return lose of the smart antenna in accordance with the second preferred embodiment of the present invention.

Please refer FIG. 7, which is a diagram showing a frequency and a return lose of the smart antenna in accordance with the second preferred embodiment of the present invention. As shown in FIG. 7, the largest antenna gain is 5 dBi when the bandwidth of antenna is 200 MHz. The smart antenna has obvious usage benefit on wireless network.

The sequence of the first to fourth antenna patterns of the present smart antenna is randomly arranged, depending on users' situations, to achieve the function of directional antenna. A plurality of smart antennas of the present invention can be printed on different positions of the printed circuit board and configured toward different directions, and the omnidirectional radiation pattern is obtained by controlling the circuit device.

In conclusion, a smart antenna of the present invention is obtained by skillfully arranging the monopole antenna and the conductors. The smart antenna has excellent and automatically switched antenna patterns, and has the advantages of large covering range and high antenna gains. The smart antenna can be effectively applied in the communication of WLAN AP/router.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A smart antenna, comprising:

a monopole antenna having a reverse triangle plane for receiving and transmitting a signal;

a first conductor with a first switch diode disposed on a first side of the monopole antenna and electrically connected to a ground, for conducting one of actions of directing the signal and reflecting the signal to the monopole antenna;

a second conductor with a second switch diode disposed on a second side of the monopole antenna and electrically connected to the ground, for conducting one of actions of directing the signal and reflecting the signal to the monopole antenna;

a circuit device electrically connected between the first conductor and the second conductor, for turning on/off the first switch diode and the second switch diode; and at least one groove disposed in the ground and horizontal with the ground, for concentrating a current of the signal received from/transmitted to the monopole antenna, wherein the smart antenna switches among four patterns formed by selectively turning on/off the first switch diode and the second switch diode.

2. The smart antenna according to claim 1, wherein the reverse triangle plane has a first edge and a second edge, where each of the first edge and the second edge has at least one cutout, and a third edge parallel to the ground, and a distance between every two neighboring cutouts is constant.

3. The smart antenna according to claim 2, wherein each of the first edge and the second edge has at least two cutouts on the plane, and a distance between every two neighboring cutouts is constant.

4. The smart antenna according to claim 2, wherein the cutout has a length increased with a decrease of a length of the third edge.

5. The smart antenna according to claim 1, wherein the at least one groove is disposed perpendicular to the monopole antenna, the first conductor and the second conductor.

6. A smart antenna, comprising:

a monopole antenna having a plane with at least three edges including a first, a second and a third edges, where each of the first edge and the second edge has at least one cutout on the plane and the third edge is parallel to the around, the plane being for receiving and transmitting a signal;

a first conductor for conducting one of actions of directing the signal and reflecting the signal to the monopole antenna;

a second conductor for conducting one of actions of directing the signal and reflecting the signal to the monopole antenna; and a circuit device electrically connected between the first conductor and the second conductor, for selectively switching the first and second conductors to determine an operation mode of the smart antenna.

7. The smart antenna according to claim 6, wherein the first conductor with a first switch diode and the second conductor with a second switch diode respectively are disposed on a first side and a second side along the monopole antenna and electrically connected to a ground, and the smart antenna switches among four patterns formed by turning on/off the first switch diode and the second switch diode.

8. The smart antenna according to claim 6, wherein the monopole antenna further comprises a feeding point being a signal input port.

9. The smart antenna according to claim 6, wherein each of the first edge and the second edge has at least two cutouts on the plane, and a distance between every adjacent two neighboring cutouts is constant.

10. The smart antenna according to claim 6, wherein the monopole antenna has a length equal to a half of a wavelength of the signal.

11. The smart antenna according to claim 6, wherein the first conductor and the second conductor have a length equal to 0.1~0.5 times of a wavelength of the signal.

12. The smart antenna according to claim 6, wherein the monopole antenna and the first conductor have a first distance therebetween equal to 0.1~0.5 times of a wavelength of the signal, and the monopole antenna and the second conductor have a second distance therebetween equal to 0.1 ~0.5 times of the wavelength of the signal.

13. The smart antenna according to claim 6, wherein the first conductor further comprises a first inductance, the second conductor further comprises a second inductance, and the first inductance and the second inductance are electrically connected to the circuit device for being blocked at a high frequency.

14. The smart antenna according to claim 6, wherein one third part of the first conductor and one third part of the second conductor are overlapped with the ground, and terminals of the first conductor and the second conductor are electrically connected to the ground.

15. The smart antenna according to claim 6, wherein each of the first conductor and the second conductor is one of a rectangle shape and a reverse L-shape.

16. The smart antenna according to claim 6, wherein the monopole antenna, the first conductor and the second conductor are made of a metal material.

17. The smart antenna according to claim 6, wherein the second conductor is opposite to the first conductor.

18. An operation method for a smart antenna, wherein the smart antenna comprises a monopole antenna having a reverse triangle plane, a first conductor, a second conductor, a circuit device, and a ground having at least one groove disposed in the ground and horizontal with the ground, the first conductor comprises a first switch diode, and the second conductor comprises a second switch diode, the operation method comprising a step of:

controlling the circuit device via turning on/off the first switch diode and turning on/off the second switch diode simultaneously, so as to switch among a plurality of operation modes of the smart antenna.

19. The operation method according to claim 18, wherein a sequence of a first, a second, a third, and a fourth antenna patterns is randomly arranged.

* * * * *